US005934121A

United States Patent [19]

Chen

[11] Patent Number: 5,934,121

[45] Date of Patent: Aug. 10, 1999

[54] LOCK APPARATUS

[76] Inventor: Waterson Chen, No. 477, Kuo-Kuang Rd. Nan Dist., Taichung City, Taiwan

[21] Appl. No.: 08/992,443

[22] Filed: Dec. 17, 1997

[51] Int. Cl.[6] ..... E05B 29/08

[52] U.S. Cl. ..... 70/365; 70/366; 70/455; 70/377; 70/403; 70/409

[58] Field of Search ..... 70/365, 366, 377, 70/386, 403, 404, 406, 407, 409, 423, 424, 427, 455

[56] References Cited

U.S. PATENT DOCUMENTS

| | | | |
|---|---|---|---|
| 3,077,101 | 2/1963 | Jacobi | 70/455 |
| 3,142,168 | 7/1964 | Wellekens | 70/455 X |
| 3,263,463 | 8/1966 | Duval et al. | 70/455 |
| 3,695,073 | 10/1972 | Prescott | 70/366 |
| 3,848,442 | 11/1974 | Mertanen | 70/366 |
| 3,877,265 | 4/1975 | Schaumberg | 70/455 X |
| 4,109,495 | 8/1978 | Roberts | 70/365 |
| 4,109,497 | 8/1978 | Roberts | 70/366 |
| 4,671,090 | 6/1987 | Masaki et al. | 70/423 X |
| 4,686,843 | 8/1987 | Martikainen et al. | 70/366 |
| 5,388,438 | 2/1995 | Paavo | 70/366 |
| 5,544,509 | 8/1996 | Mielonen | 70/366 |
| 5,613,389 | 3/1997 | Hauser | 70/366 |

FOREIGN PATENT DOCUMENTS

| | | | |
|---|---|---|---|
| 549881 | 10/1957 | Canada | 70/365 |
| 2004650 | 11/1969 | France | 70/365 |
| 379187 | 8/1923 | Germany | 70/365 |
| 266856 | 10/1952 | Switzerland | 70/366 |
| 236625 | 7/1925 | United Kingdom | 70/365 |
| 2129045 | 5/1984 | United Kingdom | 70/365 |

*Primary Examiner*—Suzanne Dino Barrett
*Attorney, Agent, or Firm*—Merchant, Gould, Smith, Edell, Welter & Schmidt

[57] ABSTRACT

A lock apparatus includes a lock device and a coded key. The lock device has a lock shell and a cylindrical lock core unit received in the lock shell. The lock core unit has an axial key hole and is provided with a latch actuator. The key is extendible into the key hole and is operable so as to permit rotation of the lock core unit relative to the lock shell for moving the latch actuator from a locking position to an unlocking position. The key has a head portion and a shank portion which has a cross-section in the form of a circular sector with first and second planar surfaces that extend along length of the shank portion, and a curved surface that interconnects the first and second planar surfaces and that has an arc length greater than 180°. The shank portion is formed with a plurality of key bit projections and key bit grooves on one of the first and second planar surfaces. The key bit projections and the key bit grooves have inclined actuating surfaces that form different angles to set code of the key. The angles are in a range from 0° to about 180°.

15 Claims, 12 Drawing Sheets

LOCK APPARATUS

BACKGROUND OF THE INVENTION

1. Field of the Invention

The present invention relates to a lock apparatus, more particularly to a lock apparatus which is suited for a wide range of applications, which has a relatively long service life, and which can provide a good anti-theft effect.

2. Description of the Related Art

A conventional lock apparatus includes a lock shell, a lock core unit received in the lock shell and having a key hole, a plurality of tumbler pins mounted on an inner surface of the lock shell, and a plurality of biasing springs for biasing the tumbler pins to extend into the key hole so as to prevent rotation of the lock core unit relative to the lock shell, thereby placing the lock core unit in a locking position. When a correct key is inserted into the key hole, the tumbler pins are pushed by key bit projections and key bit grooves on the key to disengage the lock core unit, thereby permitting rotation of the lock core unit relative to the lock shell to place the lock core unit in an unlocking position. The conventional lock apparatus suffers from the following disadvantages:

1. The tumbler pins are biased by spring members when the lock apparatus is in the locking position. When a strong acid is poured by a thief into the key hole to seriously corrode and damage the spring members, the lock apparatus will cease to work. Thus, the lock apparatus provides a relatively poor anti-theft effect.
2. Since no cover means is provided for covering the key hole after the key is removed from the key hole, components of the lock apparatus are easily corroded and damaged due to the entry of dust and moisture into the key hole, thereby shortening the service life of the lock apparatus.
3. The lock apparatus is usually designed for a certain type of lock and is not suited for a wide range of applications.

SUMMARY OF THE INVENTION

The main object of the present invention is to provide a lock apparatus which is suited for a wide range of applications, which has a relatively long service life, and which can provide a good anti-theft effect.

Accordingly, the lock apparatus of the present invention includes a lock device and a coded key. The lock device has a lock shell and a cylindrical lock core unit received in the lock shell. The lock core unit has an axial key hole and is provided with a latch actuator. The coded key is extendible into the key hole of the lock core unit and is operable so as to permit rotation of the lock core unit relative to the lock shell for moving the latch actuator from a locking position to an unlocking position. The key has a head portion and a shank portion that extends from the head portion. The shank portion has a cross-section in the form of a circular sector with first and second planar surfaces that extend along length of the shank portion, and a curved surface that interconnects the first and second planar surfaces and that has an arc length greater than 180°. The shank portion is formed with a plurality of key bit projections and key bit grooves on one of the first and second planar surfaces. The key bit projections and the key bit grooves have inclined actuating surfaces that form different angles with said one of the first and second planar surfaces to set code of the key. The angles are in a range from 0° to about 180°.

Preferably, the lock shell has an inner surface which confines a cylindrical receiving space for receiving the lock core unit and which is formed with an axially extending locking groove. The lock core unit includes a cylindrical inner shell, a stack of annular lock plates and a locking rod. The inner shell is formed with an axially extending locking slot that is registered with the locking groove when the lock core unit is in the locking position. The annular locking plates are received in the inner shell. Each of the locking plates has an inner periphery that confines a central hole. The central holes of the locking plates define cooperatively the key hole of the lock core unit. Each of the locking plates further has an outer periphery that is formed with an engaging notch. The engaging notches of the locking plates are misaligned with one another in accordance with the code of the key when the lock core unit is in the locking position, and are aligned with one another when the lock core unit is in the unlocking position. The inner periphery of each of the locking plates is formed with a radial inward key engaging protrusion. The key engaging protrusion has a first radial edge to abut against the actuating surface of a corresponding one of the key bit projections and the key bit grooves on the key when the key is received in the key hole and is rotated to unlock the lock core unit, thereby permitting rotation of the lock plates by different angles corresponding to the angles of the actuating surfaces of the key bit projections and the key bit grooves on the key in order to align the engaging notches on the locking plates. The key engaging protrusion further has a second radial edge opposite to the first radial edge to abut against the other one of the first and second planar surfaces of the shank portion of the key when the key is received in the key hole and is rotated to lock the lock core unit, thereby permitting rotation of the locking plates in order to misalign the engaging notches on the locking plates according to the code of the key. The locking rod is received in the locking slot. Misalignment of the engaging notches on the locking plates enables the outer peripheries of the locking plates to force the locking rod to extend into the locking groove in order to prevent rotation of the inner shell relative to the lock shell when the lock core unit is in the locking position. Alignment of the engaging notches on the locking plates enables the locking rod to disengage the locking groove and to engage the engaging notches in order to permit rotation of the inner shell relative to the lock shell when the lock core unit is in the unlocking position.

In a preferred embodiment, the arc length of the curved surface of the shank portion of the key is about 270°. In addition, the lock shell has a front end portion provided with spring-loaded cover means for covering the key hole of the lock core unit when the key is removed from the lock core unit.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
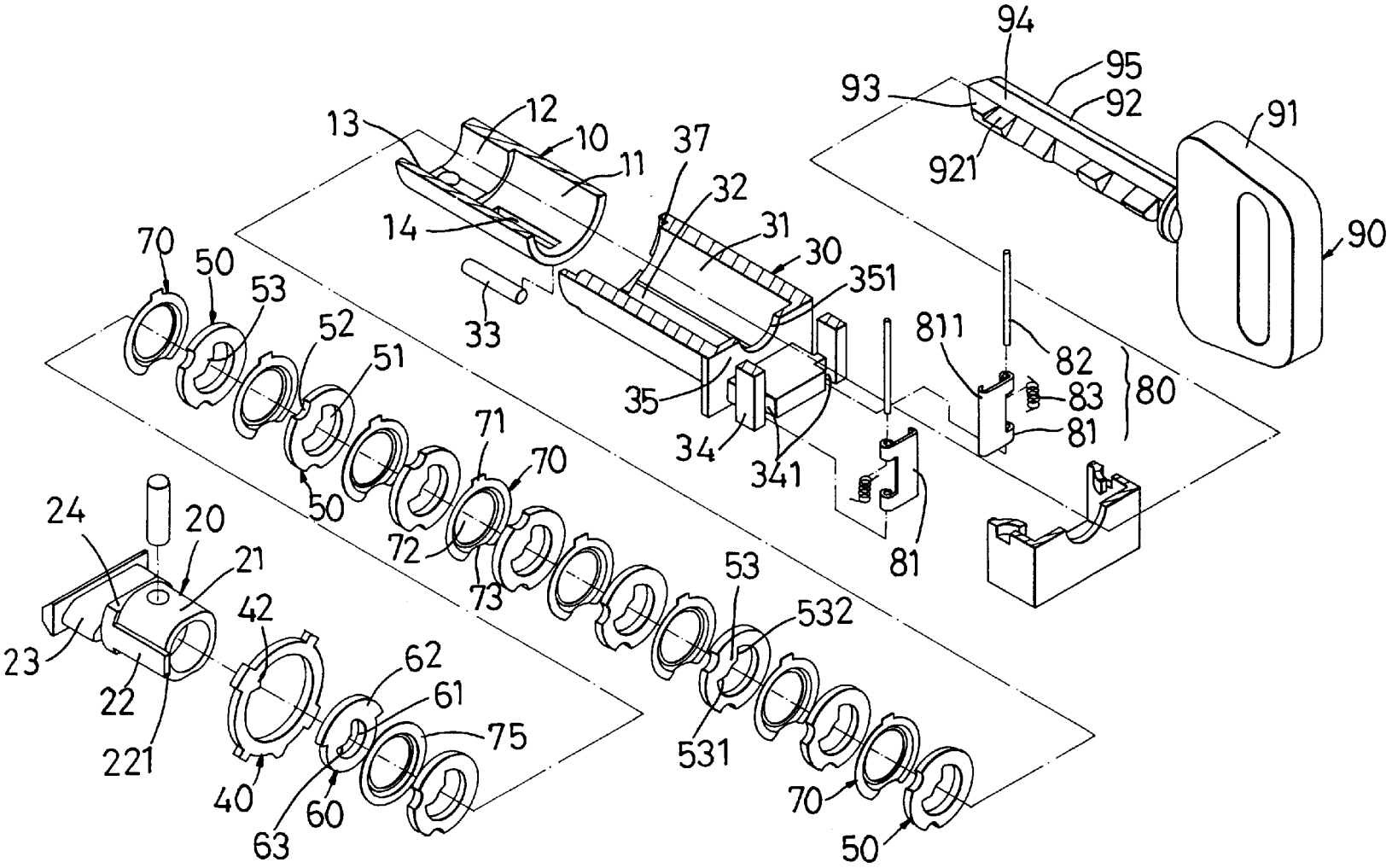
FIG. 1 is an exploded, inverted perspective view of a first preferred embodiment of a lock apparatus of the present invention.
Figure 2:
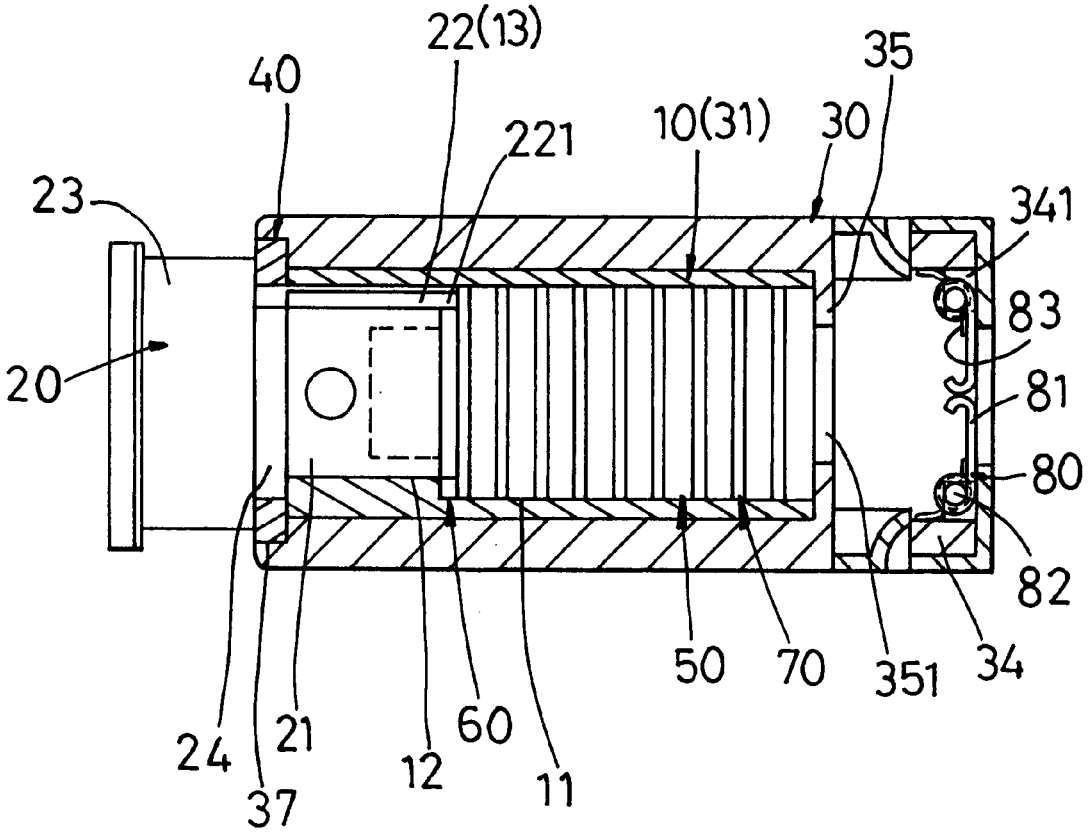
FIG. 2 is a sectional view of the first preferred embodiment, wherein a key is removed therefrom.

Referring to FIGS. 1 and 2, the lock apparatus of the first preferred embodiment of the present invention is shown to comprise a coded key 90 and a lock device which includes a lock shell 30 and a lock core unit. The lock core unit includes a cylindrical inner shell 10, a latch actuator 20, a stack of annular lock plates 50, a locking rod 33, an annular drive plate 60, and a plurality of spacer plates 70. The components of the lock device are preferably made of stainless steel to prevent damage thereof due to corrosion.

Referring to FIG. 1, the coded key 90 has a head portion 91 and a shank portion 92 that extends from the head portion 91. The shank portion 92 has a cross-section in the form of a circular sector with first and second planar surfaces 93, 94 that extend along length of the shank portion 92, and a curved surface 95 that interconnects the first and second planar surfaces 93, 94 and that has an arc length greater than 180°. In the present embodiment, the cross-section of the shank portion 92 forms three-quarters of a circle such that the arc length of the curved surface 95 is about 270° and such that the first planar surface 93 is generally horizontal and the second planar surface 94 is generally vertical. The shank portion 92 is formed with a plurality of key bit projections and key bit grooves on the horizontal first planar surface 93 along the length of the shank portion 92. The key bit projections and the key bit grooves have inclined actuating surfaces 921 that are inclined relative to the first planar surface 93 and that form different angles with the first planar surface 93 to set the code of the key 90. The angles are in a range from 0° to 180°. Thus, the shank portion 92 of the key 90 maintains a base part with a cross-section in the form of a quarter of a circle. In the present embodiment, the total number of the key bit projections and the key bit grooves is nine.

Figure 3:
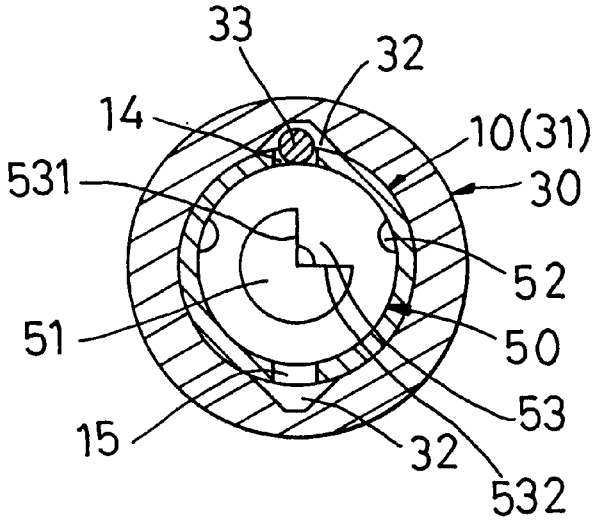
FIG. 3 is another sectional view of the first preferred embodiment, wherein a lock core unit of the lock apparatuses in a locking position.

As shown in FIGS. 1 to 3, the lock shell 30 has an inner surface which confines a cylindrical receiving space 31 and which is formed with an opposite pair of axially extending locking grooves 32. The lock shell 30 further has a front end portion formed with a front end wall 35 that has an opening 351 communicated with the receiving space 31. The front end portion is provided with spring loaded cover means 80 for covering the opening 351. The lock shell 30 further has a rear end portion formed with an annular recess 37 for receiving a retaining ring 40. The spring-loaded cover means 80 and the retaining ring 40 will be described later. The cylindrical inner shell 10 of the lock core unit is received in the cylindrical receiving space 31 of the lock shell 30. The inner shell 10 has an axially extending locking slot 14 formed radially through an upper portion of a surrounding wall thereof, and an axially extending retaining slot 15 opposite to the locking slot 14. The inner shell 10 confines a front chamber 11 and a rear chamber 12, and is further formed with an axially extending retaining groove 13 at a periphery of the rear chamber 12.

The annular locking plates 50 are received in the front chamber 11 of the inner shell 10. Nine to twelve locking plates 50 may be installed in the inner shell 10. In the present embodiment, nine locking plates 50 are in use to be consistent with the total number of the key bit projections and the key bit grooves on the key 90. Each of the locking plates 50 has an inner periphery that confines a central hole 51. The central holes 51 of the locking plates 50 cooperatively define a key hole which is aligned with the opening 351 in the front end wall 35 of the lock shell 30 to permit extension of the coded key 90 into the key hole via the opening 351. Each of the locking plates 50 further has an outer periphery that is formed with an engaging notch 52. The inner periphery of each of the locking plates 50 is further formed with a radial inward key engaging protrusion 53 for engaging a corresponding one of the key bit projections and the key bit grooves when the key 90 is received in the key hole. Each key engaging protrusion 53 has opposite first and second radial edges 531, 532.

The spacer plates 70 are disposed between adjacent pairs of the locking plates 50. Each of the spacer plates 70 is formed with a central opening 72 to permit extension of the key 90 therethrough, and has an outer periphery formed with a radial outward positioning projection 71 and a radial indentation 73 opposite to the positioning projection 71. The positioning projections 71 of the locking plates 70 extend into the retaining slot 15 of the inner shell 10 to permit rotation of the spacer plates 70 together with the inner shell 10. The radial indentations 73 of the locking plates 70 are registered with the locking slot 14 of the inner shell 10.

The drive plate 60 is disposed in the front chamber 11 adjacent to the rear chamber 12. A spacer ring 75 is provided between the drive plate 60 and a rearmost one of the locking plates 50. The drive plate 60 has a key engaging inner periphery 63 which confines a central hole 61, and an outer periphery which is formed with a radial cam projection 62 that is shaped as a circular sector.

The latch actuator 20 has a generally cylindrical front end portion 21 that extends into the rear chamber 12 of the inner shell 10. The front end portion 21 has an outer surface formed with an axially extending rib 22 which extends into the retaining groove 13 in the rear chamber 12 of the inner shell 10 for coupling the latch actuator 20 to the inner shell 10 so that the latch actuator 20 is rotatable together with the inner shell 10. The rib 22 has a cam actuatable section 221 which projects forwardly relative to the cylindrical front end portion 21 of the latch actuator 20 and which extends to the outer periphery of the drive plate 60. The latch actuator 20 further has an actuating rear end portion 23 that extends out of the rear chamber 12 of the inner shell 10, and a non-circular (generally rectangular in the present embodiment) restricted neck portion 24 between the front and rear end portions 21, 23. The actuating rear end portion 23 has a T-shaped cross-section in the present embodiment. The shape of the actuating rear end portion 23 depends on the type of lock body to which the lock apparatus of the present embodiment is applied.

The retaining ring 40 is mounted to the lock shell 30 at the annular recess 37 via a rivet joint. The retaining ring 40 is disposed around the restricted neck portion 24 of the latch actuator 20, and is formed with a radial inward limiting projection 42 to limit rotation of the neck portion 24.

Referring to FIG. 3, when unlocking the lock core unit, the key engaging protrusions 53 of the locking plates 50 are aligned with one another to form the key hole with a cross-section in the form of three-quarters of a circle to permit extension of the key 90, which also has a cross-section in the form of three-quarters of a circle, thereinto. The notches 52 on the locking plates 50 are initially misaligned (see FIG. 1) so that the locking rod 33 is forced by the outer peripheries of the locking plates 50 to extend into the locking groove 32 of the lock shell 30 to prevent rotation of the inner shell 10 relative to the lock shell 30. Under this situation, when an incorrect key is inserted into the key hole and is rotated, the notches 52 on the locking plates 50 are kept misaligned since the code of the incorrect key does not correspond with that of the locking plates 50. The locking rod 33 is still retained in the locking groove 32 to maintain the lock core unit in the locking position. Rotation of the key can only result in idle rotation of the locking plates 50 within the inner shell 30.

Figure 4:
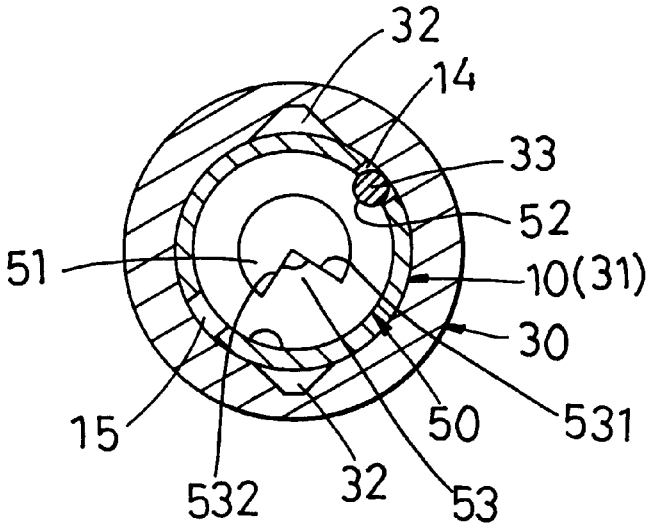
FIG. 4 is still another sectional view of the first preferred embodiment, wherein the lock core unit of the lock apparatus is in an unlocking position.
Figure 5:
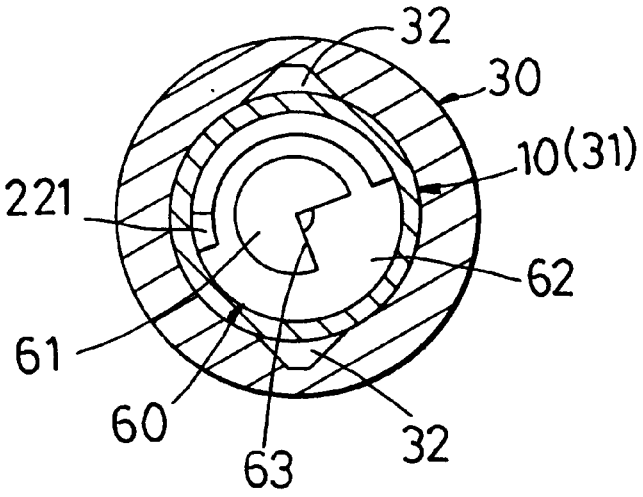
FIG. 5 is still another sectional view of the first preferred embodiment, illustrating how a latch actuator is driven by a drive plate.

Referring to FIGS. 1 and 4, when the correct key 90 is inserted into the key hole and is rotated, the first radial edge 531 of the key engaging protrusion 53 of each of the locking plates 50 abuts against the actuating surface 921 of a corresponding one of the key bit projections and the key bit grooves on the key 90 so that the locking plates 50 are rotated by different angles corresponding to the angles of the actuating surfaces 921 of the key bit projections and the key bit grooves on the key 90 to align the engaging notches 52 on the locking plates 50. When the locking plates 50 are rotated by the key 90 until the aligned notches 52 are registered with the locking slot 14, the locking rod 33 is permitted to fall into the notches 52 to engage the same and to disengage the locking groove 32 of the lock shell 30, thereby permitting rotation of the inner shell 10 relative to the lock shell 30. At this time, referring to FIGS. 1 and 5, the key 90 can be further extended so that tip of the key 90 extends into the central hole 61 of the drive plate 60 to engage the key engaging inner periphery 63 of the drive plate 60. The drive plate 60 is thus rotatable together with the key 90 to enable the cam projection 62 thereof to contact and drive the cam actuatable section 221 of the latch actuator 20 for rotating the latch actuator 20 from a locking position to an unlocking position.

Referring to FIGS. 1, 3 and 4, to return the lock core unit to the locking position, the key 90 is rotated in an opposite direction so that the second planar surface 94 abuts against the second radial edges 532 of the key engaging protrusions 53 of the locking plates 50 in order to rotate the locking plates 50 by different angles to misalign the engaging notches 52 according to the code of the key 90. The locking rod 33 is thus forced to extend into the locking groove 32 of the lock shell 30.

Figure 6:
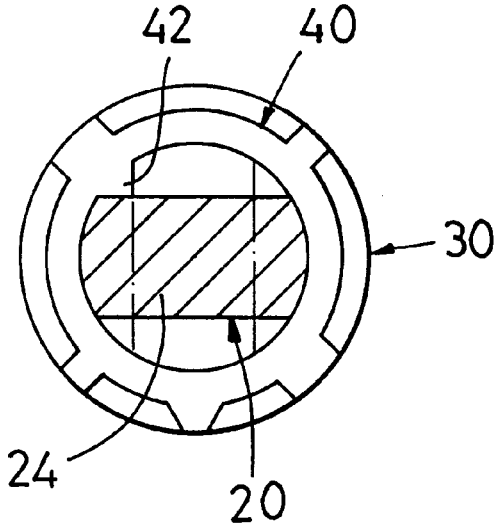
FIG. 6 is a schematic view of the first preferred embodiment, illustrating how a retaining ring limits rotation of the latch actuator.

Referring to FIG. 6, since the retaining ring 40 is disposed around the restricted neck portion 24 of the latch actuator 20 and has the limiting projection 42 formed at an inner periphery thereof, rotation of the latch actuator 20 due to rotation of the key 90 and the drive plate 60 is limited by the limiting projection 42 within a certain range, for example, in a range of 90° in the present embodiment.

Figure 7A:
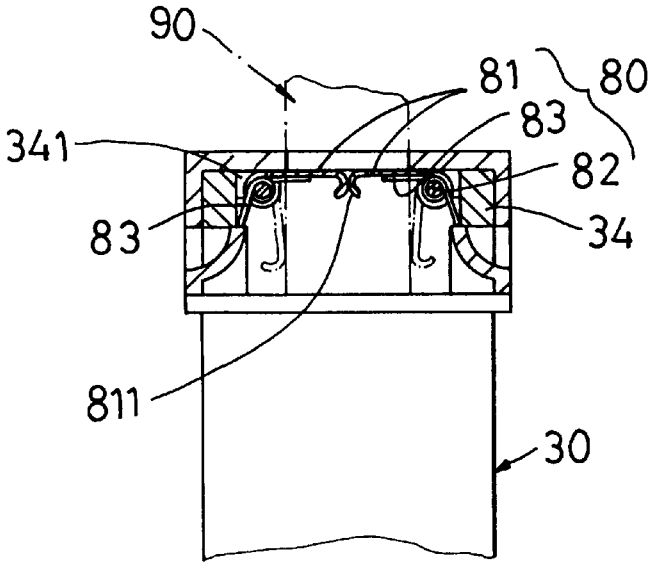
FIG. 7A is a partly sectional view illustrating operation of spring-loaded cover means of the first preferred embodiment.

Referring to FIGS. 1 and 7A, the spring-loaded cover means 80 includes a pair of cover plates 81 and a pair of biasing springs 83. As shown, the cover plates 81 are mounted pivotally on two opposite sides of the front end portion of the lock shell 30 by means of two pivot shafts 82 that are received in two opposite pin grooves 341 in the front end portion of the lock shell 30. The biasing springs 83 are in the form of torsion springs and are sleeved on the pivot shafts 82, respectively. Each of the biasing springs 83 has a first end abutting against a respective side wall 34 of the front end portion of the lock shell 30, and a second end abutting against an inner side of a respective one of the cover plates 81 for biasing the cover plates 81 to a closed position relative to the lock shell 30, where the cover plates 81 extend pivotally toward each other so that inner edges 811 of the cover plates 81 are located adjacent to one another to close cooperatively the key hole of the lock core unit. The inner edges 811 of the cover plates 81 are slightly curved to facilitate insertion of the key 90 therebetween. Insertion of the key 90 between the inner edges 811 of the cover plates 81 can cause the cover plates 81 to pivot and extend into the lock shell 30 against biasing action of the biasing springs 83 so as to uncover the key hole.

Figure 7B:
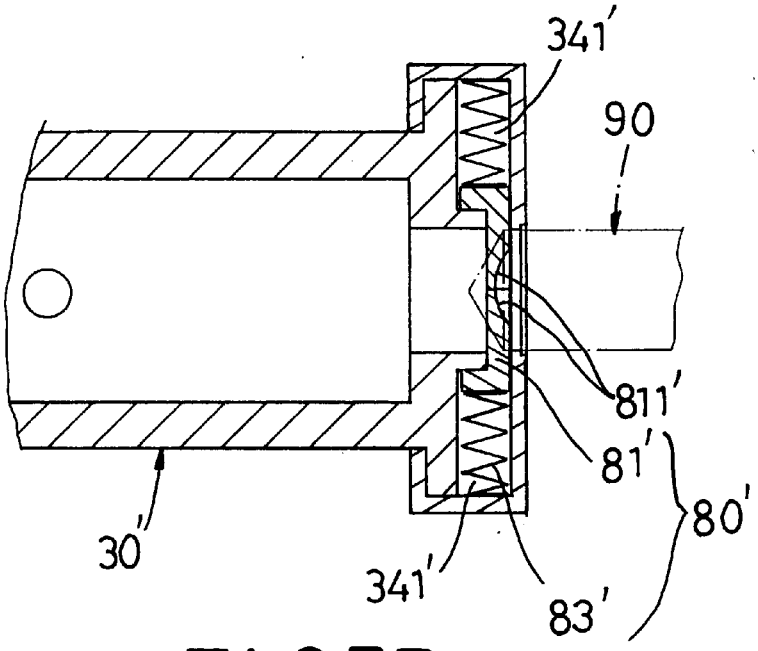
FIG. 7B is a partly, vertical sectional view illustrating spring-loaded cover means of a lock apparatus of a second preferred embodiment.

Referring to FIG. 7B, in a second preferred embodiment, the front end portion of the lock shell 30' is provided with spring-loaded cover means 80' which includes a pair of cover plates 81' and a pair of biasing springs 83'. The front end portion of the lock shell 30' is formed with opposite upper and lower slide grooves 341' which extend vertically. The biasing springs 831 are in the form of compression springs and are received in the slide grooves 341', respectively. The cover plates 81' are disposed on opposite sides of the front end portion of the lock shell 30' between the biasing springs 83'. The cover plates 81' are biased by the biasing springs 83' to slide toward each other to a closed position relative to the lock shell 30' to close cooperatively the key hole of the lock core unit. As shown, the cover plates 81' have adjacent complementary indented edge portions 811' to enable the key 90 to force apart the cover plates 81' when the key 90 is inserted therebetween. Insertion of the key 90 between the cover plates 81' causes the cover plates 81' to move away from each other against biasing action of the biasing springs 83' so as to uncover the key hole.

Figure 7C:
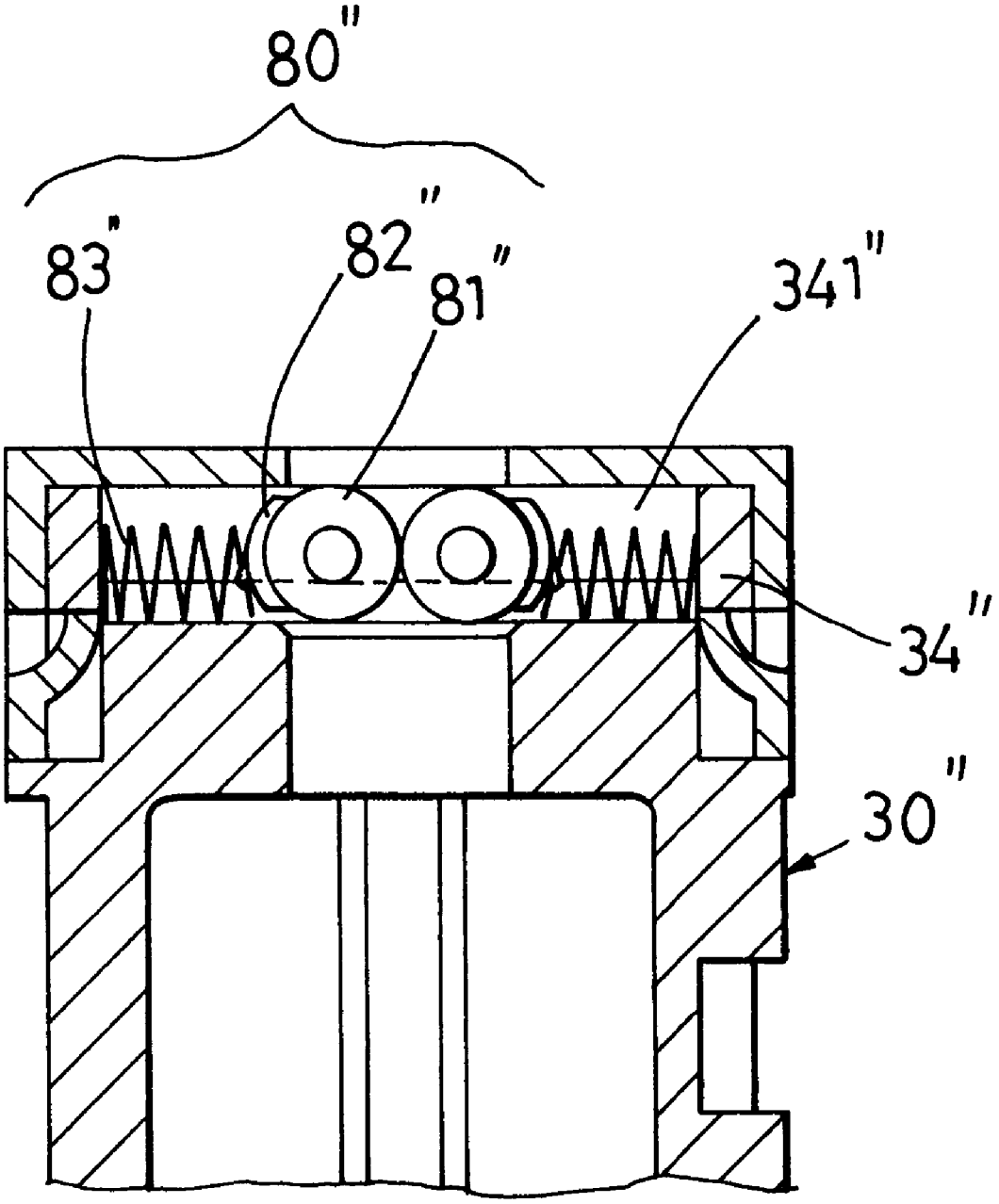
FIG. 7C is a partly sectional view illustrating spring-loaded cover means of a lock apparatus of a third preferred embodiment of this invention.

Referring to FIG. 7C, in a third preferred embodiment, the front end portion of the lock shell 30" is provided with spring-loaded cover means 80" which includes a parallel pair of cylindrical rollers 81", and a pair of biasing springs 83". The cylindrical rollers 81" are mounted rollingly on opposite sides of the front end portion of the lock shell 30". Each of the biasing springs 83" is in the form of a compression spring and has a first end secured to a side wall 34" of the front end portion and a second end connected to a curved plate 82" which conforms with a periphery of a respective one of the roller 81". The biasing springs 83" bias the rollers 81" to a closed position relative to the lock shell 30", where the rollers 81" move rollingly toward each other to close cooperatively the key hole of the lock core unit. Insertion of the key 90 between the rollers 81" causes the rollers 81" to move away from each other against biasing action of the biasing springs 83" so as to uncover the key hole.

Since the latch actuator 20 of the present invention is mounted detachably on the inner shell 10 of the lock core unit, the lock apparatus of the present invention can be applied to different types of locks, for example, a padlock, a gearshift stick lock, a motorcycle lock or a door lock, by varying the shape of the actuating rear end portion 23 of the latch actuator 20 to suit the structure of the lock to which the lock apparatus is applied.

Figure 8A:
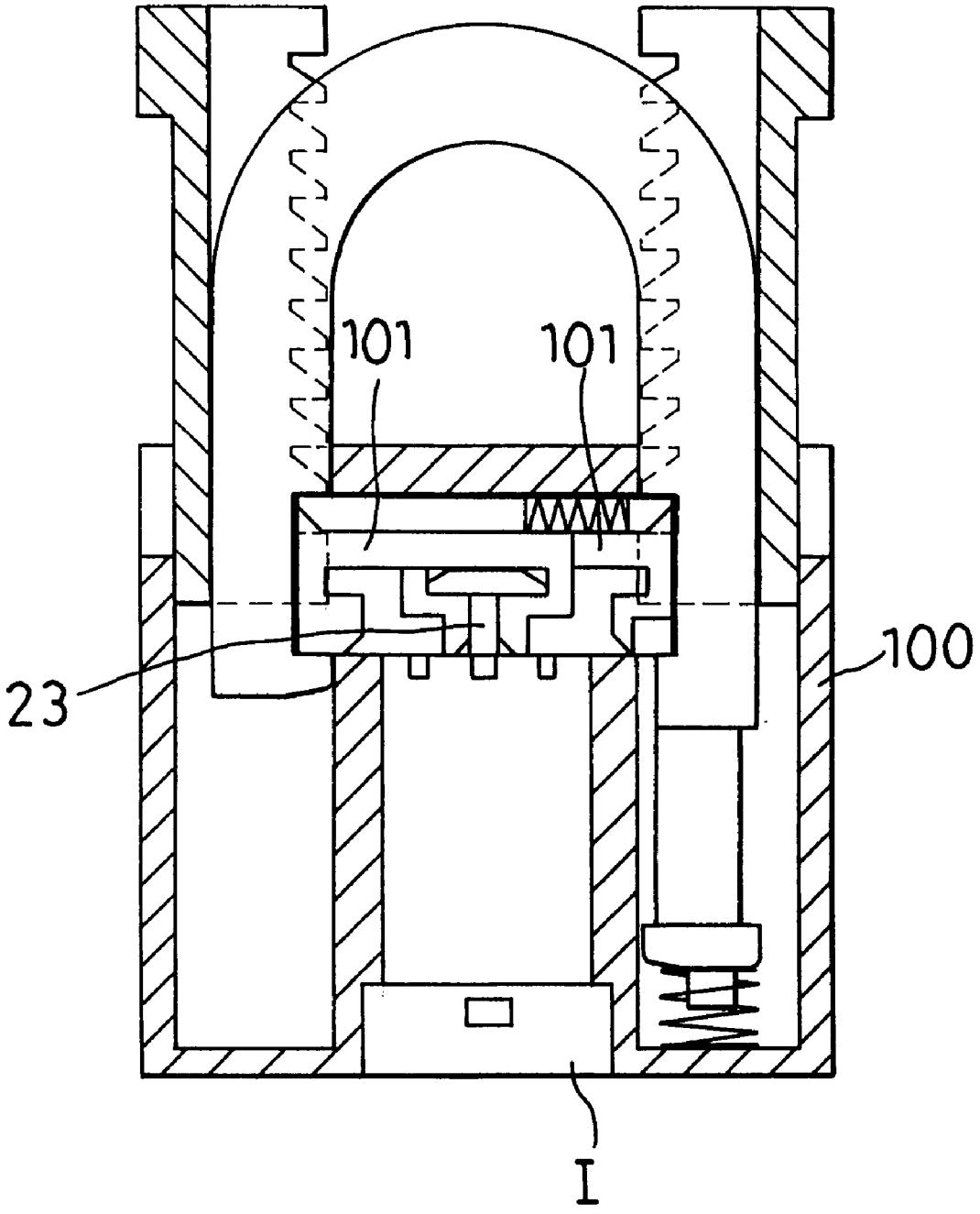
FIG. 8A is a schematic view showing a padlock to which the lock apparatus of the present invention is applied.

FIG. 8A illustrates a padlock 100 to which the lock apparatus (I) of the present invention is applied. The lock apparatus (I) has a latch actuator with a T-shaped actuating rear end portion 23. The padlock 100 has a pair of latch members 101 which are disposed side by side and which engage the actuating rear end portion 23. The latch actuator is operable by a correct key to rotate the actuating rear end portion 23 so as to permit retraction of the latch members 101 inwardly for unlocking the padlock 100. The latch members 101 engage the actuating rear end portion 23 of the latch actuator of the lock apparatus (I) for cooperatively retaining the lock apparatus (I) in the padlock 100.

Figure 8B:
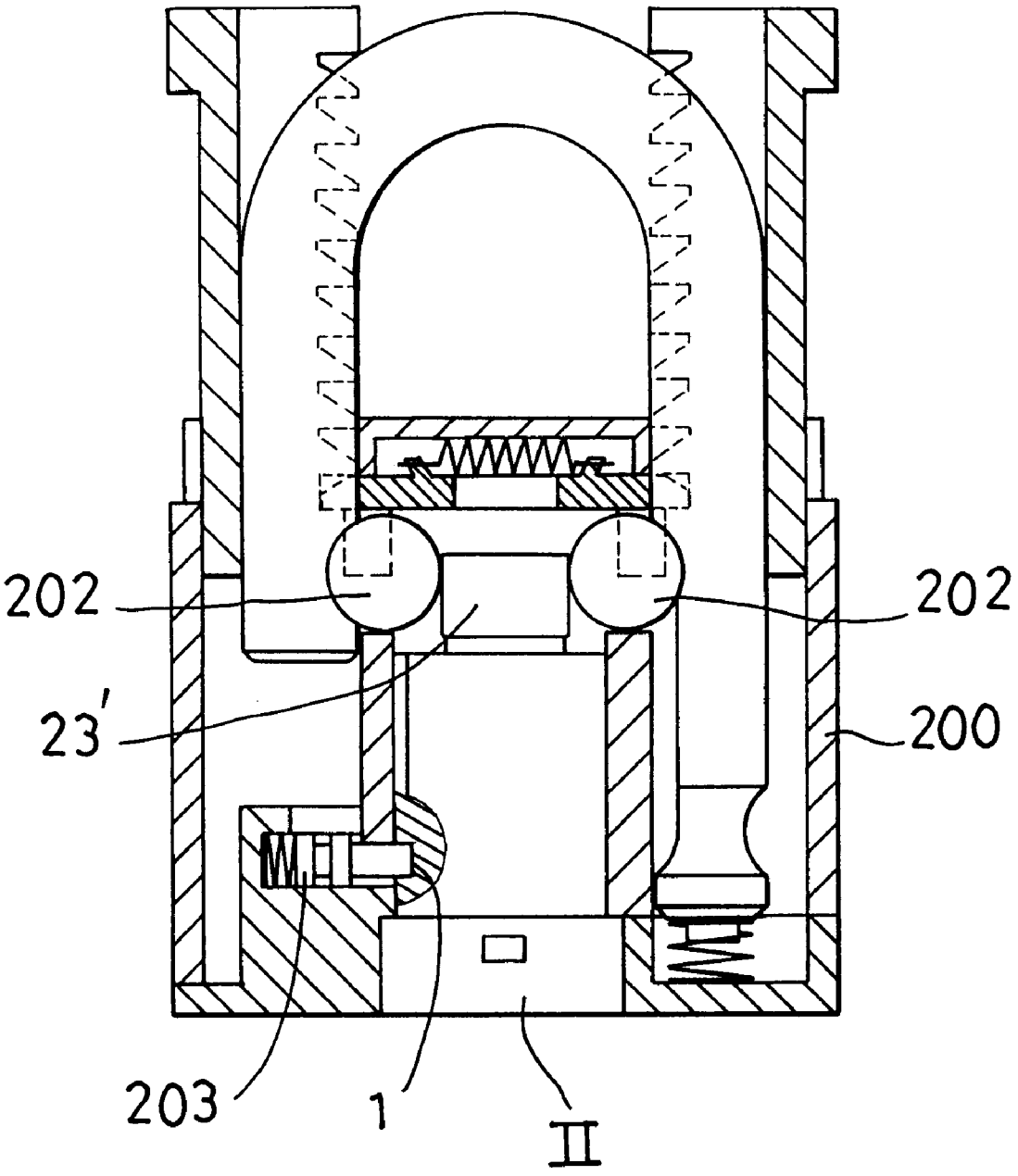
FIG. 8B is a schematic view showing another padlock to which the lock apparatus of the present invention is applied.

FIG. 8B illustrates another type of padlock 200 to which the lock apparatus (II) of the present invention is applied. The lock apparatus (II) has a latch actuator with a rectangular actuating rear end portion 23' which forces apart two ball members 202 of the padlock 200 for placing the padlock 200 in a locking position. Rotation of the actuating rear end portion 23' by the correct key permits retraction of the ball members 202 toward one another to place the padlock 200 in an unlocking position. The lock shell of the lock apparatus (II) has an outer surface formed with a retaining groove 1 to permit extension of a spring-loaded retaining member 203 thereinto for retaining the lock apparatus (II) in the padlock 200.

Figure 8C:
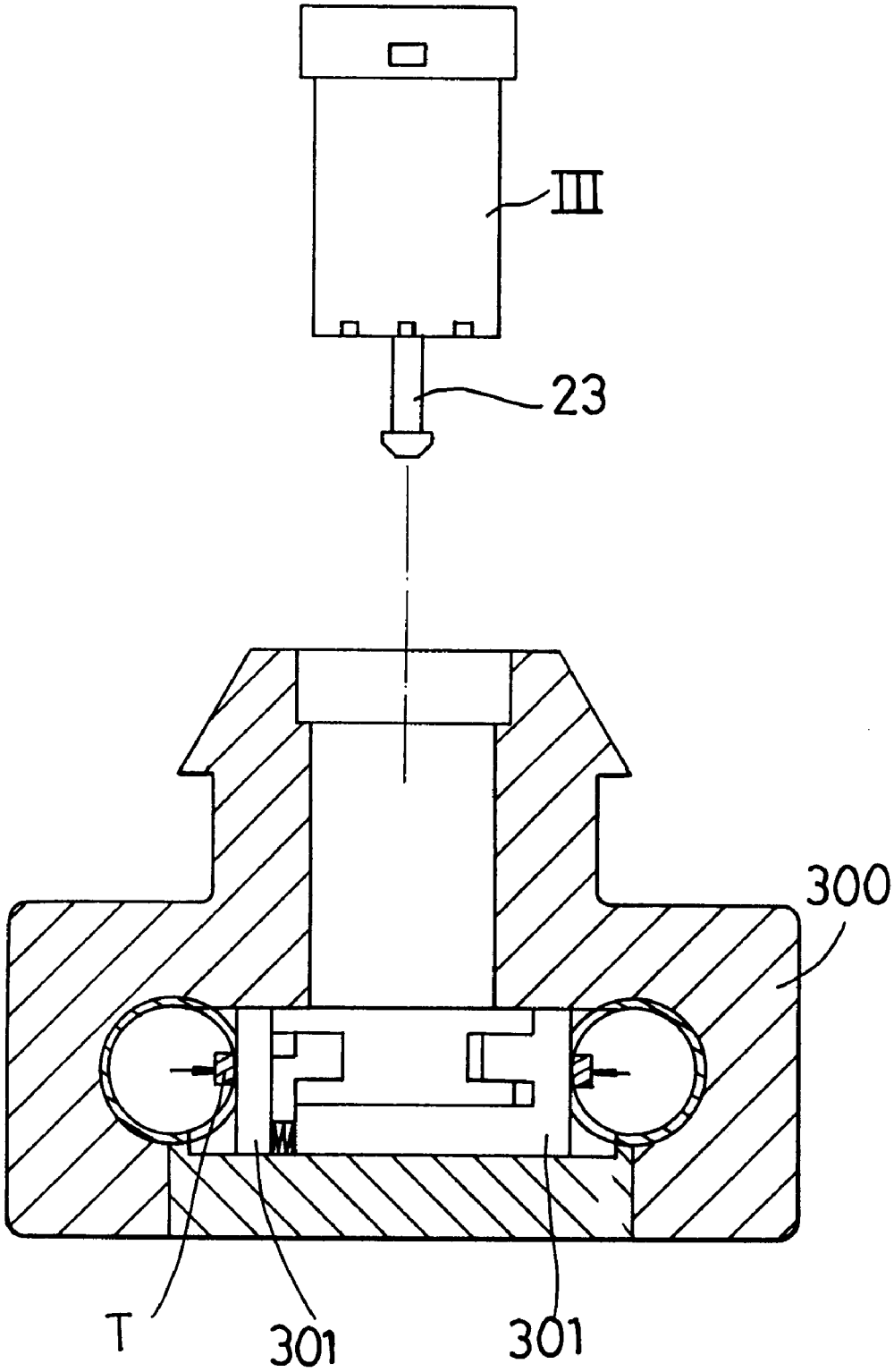
FIG. 8C is a schematic view showing a gearshift stick lock to which the lock apparatus of the present invention is applied.

FIG. 8C illustrates a gearshift stick lock 300 to which a lock apparatus (III) of the present invention is applied. The lock apparatus (III) has a latch actuator with a T-shaped actuating rear end portion 23 for engaging a pair of latch members 301 of the padlock 300. Operation of the lock apparatus (III) in the gearshift stick lock 300 is similar to that of the lock apparatus (I) in the padlock 100 of FIG. 8A. The latch members 301 can be forced inwardly by a tool (T) that is extended into the shackle insert holes of the lock 300 for removal of the lock apparatus (III) when replacing the same with a new one.

Figure 8D:
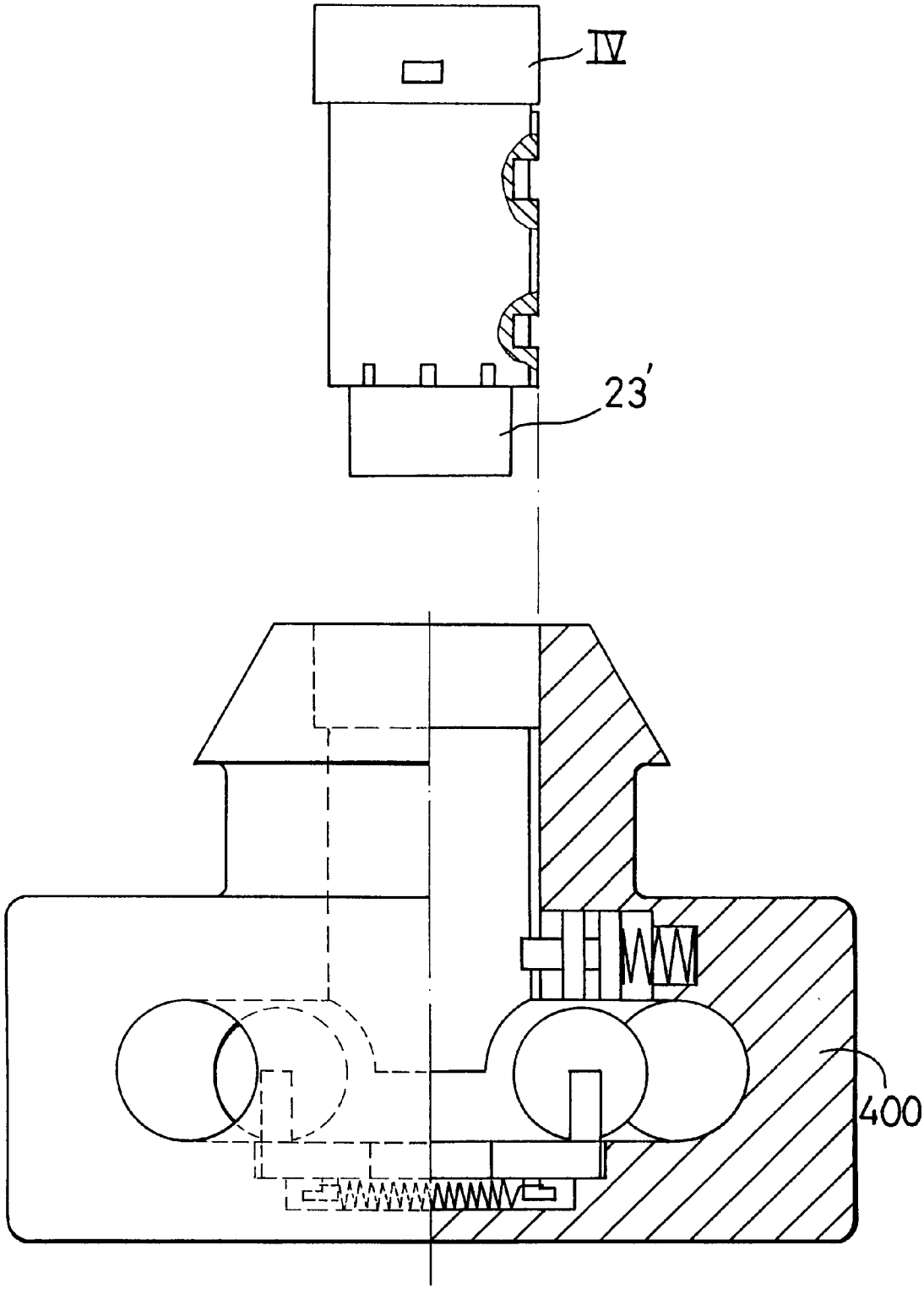
FIG. 8D is a schematic view showing another gearshift stick lock to which the lock apparatus of the present invention is applied.

FIG. 8D illustrates another gearshift stick lock 400 to which a lock apparatus (IV) of the present invention is applied. The lock apparatus (IV) has a latch actuator with a rectangular actuating rear end portion 23'. Operation of the lock apparatus (IV) in the gearshift stick lock 400 is similar to that of the lock apparatus (II) in the padlock 200 of FIG. 8B.

Figure 8E:
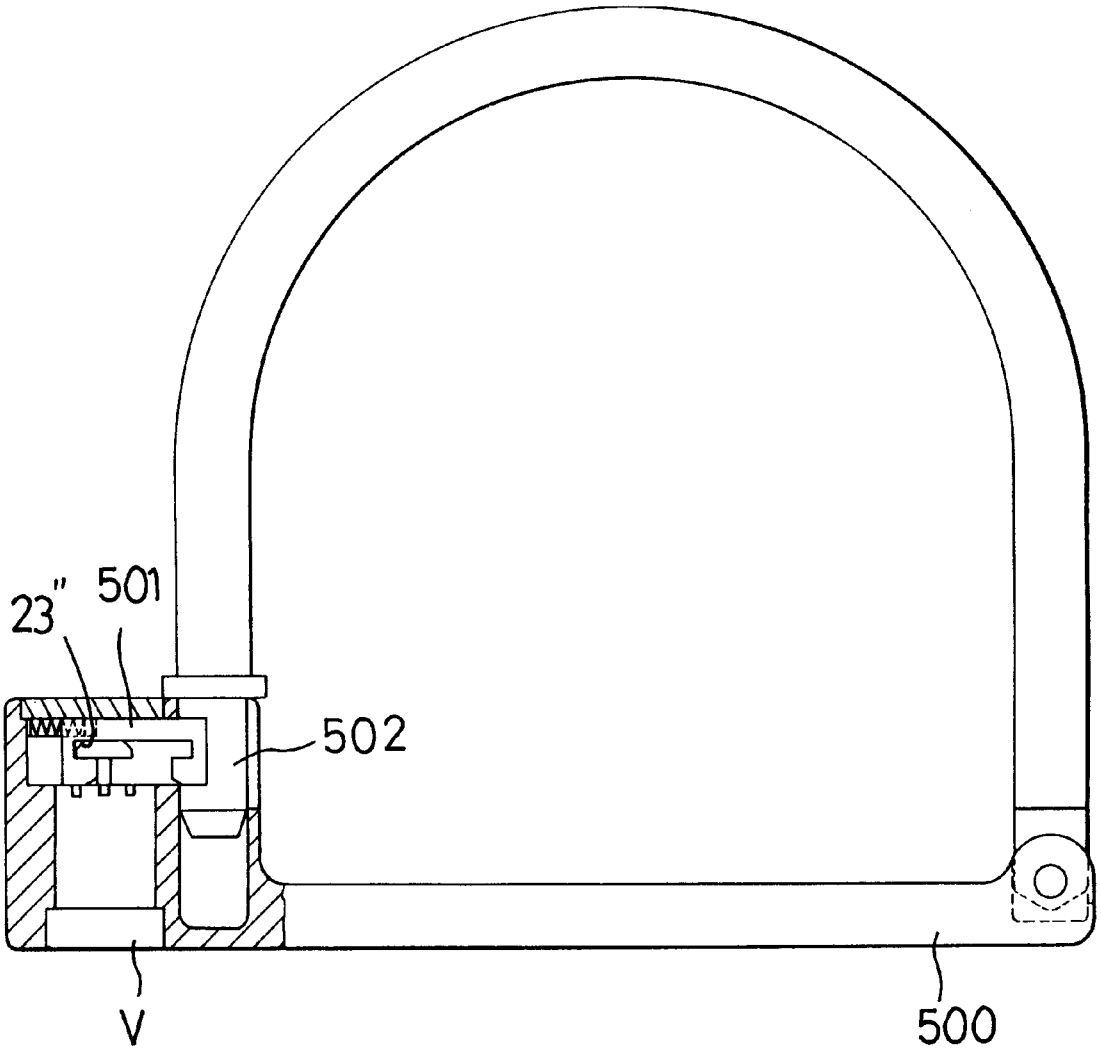
FIG. 8E is a schematic view showing a motorcycle lock to which the lock apparatus of the present invention is applied.

FIG. 8E illustrates a motorcycle lock 500 to which a lock apparatus (V) of the present invention is applied. The lock apparatus (V) has a latch actuator with a cross-shaped actuating rear end portion 23". The lock 500 has a spring-loaded latch member 501. Rotation of the actuating rear end portion 23" can cause the latch member 501 to disengage the shackle 502 for unlocking the lock 500.

In the lock apparatus of the present invention, the positions of the notches 52 on the locking plates 50 must correspond to the angles of the actuating surfaces 921 of the key bit projections and the key bit grooves on the key 90 to permit operation of the key 90 in the lock core unit for unlocking the lock core unit. Therefore, the code of the key 90 can be set by the angles of the actuating surfaces 921 and the total number of the key bit projections and the key bit grooves on the key 90. In the illustrated embodiments, the key 90 has a cross-section that forms three-quarters of a circle. Considering that a base portion with a cross-section in the form of a quarter of a circle is to be maintained on the key 90, the angles of the actuating surfaces 921 of the key bit projections and the key bit grooves on the key 90 can be varied in a range from 0 to 180°. Therefore, a relatively large number of codes can be selected for the key 90. The large number of codes ensures that all of the keys can be made different by setting different codes thereon when a large number of the lock apparatus is to be produced.

Figure 9A:
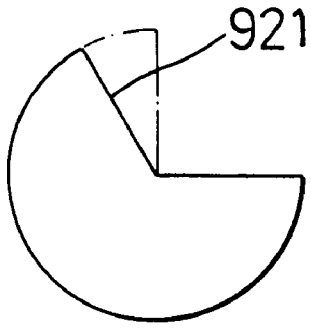
FIG. 9A is a cross-sectional schematic view of a shank portion of the key of a lock apparatus according to the present invention in which the key bit projections and the key bit grooves are formed on a vertical surface of the shank portion of the key.
Figure 9B:
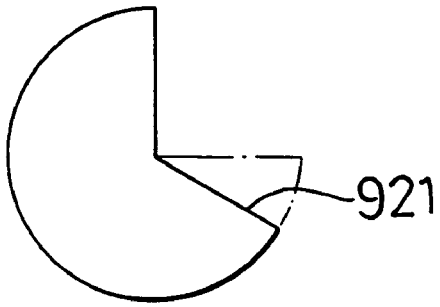
FIG. 9B is a cross-sectional schematic view of the shank portion of the key of a lock apparatus according to the present invention in which the key bit projections and the key bit grooves are formed on a horizontal surface of the shank portion of the key.

The locking plates 50 are designed in correspondence with code of the key 90. There are 180 different locking plates 50 with the notches 52 located at different angles thereon. In addition, when manufacturing the lock apparatus of the present invention, the locking rod 33 can be arranged to extend into a selected one of the two locking grooves 32, thereby doubling the number of the codes. Referring to FIGS. 9A and 9B, the key bit projections and the key bit grooves can be formed on the vertical planar surface via a cutting operation in an anti-clockwise direction, as shown in FIG. 9A, or on the horizontal planar surface via a cutting operation in a clockwise direction, as shown in FIG. 9B. The number of codes that can be set on the key 90 is thus doubled.

It has been shown that a relatively large number of codes can be set on the key. The lock apparatus of the present invention thus provides an enhanced anti-theft effect. With the inclusion of the spring-loaded cover means to prevent the entry of dust and moisture into the key hole of the lock core unit, the components of the lock apparatus can be maintained in good condition to prolong the service life of the same. In addition, since the latch actuator is mounted detachably on the inner shell of the lock core unit, the lock apparatus of the present invention can be adapted for application to various types of locks by varying the shape of the actuating rear end portion of the latch actuator to suit the structure of the intended application.

With this invention thus explained, it is apparent that numerous modifications and variations can be made without departing from the scope and spirit of this invention. It is therefore intended that this invention be limited only as indicated in the appended claims.

I claim:

1. A lock apparatus, comprising:

a lock device which has a lock shell and a cylindrical lock core unit received in said lock shell, said lock core unit having an axial key hole and being provided with a latch actuator; and a coded key which is extendible into said key hole of said lock core unit and which is operable so as to permit rotation of said lock core unit relative to said lock shell for moving said latch actuator from a locking position to an unlocking position, said key having a head portion and a shank portion that extends from said head portion, said shank portion having a cross-section in the form of a circular sector with first and second planar surfaces that extend along length of said shank portion, and a curved surface that interconnects said first and second planar surfaces and that has an arc length greater than 180°, said shank portion being formed with a plurality of key bit projections and key bit grooves on one of said first and second planar surfaces, said key bit projections and said key bit grooves having inclined actuating surfaces that form different angles with said one of said first and second planar surfaces to set code of said key, said angles being in a range from 0° to about 180°.

2. The lock apparatus as claimed in claim 1, wherein:

said lock shell has an inner surface which confines a cylindrical receiving space for receiving said lock core unit and which is formed with an axially extending locking groove;

said lock core unit including:

a cylindrical inner shell which is formed with an axially extending locking slot that is registered with said locking groove when said lock core unit is in the locking position, a stack of annular locking plates received in said inner shell, each of said locking plates having an inner periphery that confines a central hole, said central holes of said locking plates defining cooperatively said key hole of said lock core unit, each of said locking plates further having an outer periphery that is formed with an engaging notch, said engaging notches of said locking plates being misaligned with one another in accordance with the code of said key when said lock core unit is in the locking position, and being aligned with one another when said lock core unit is in the unlocking position, said inner periphery of each of said locking plates being formed with a radial inward key engaging protrusion, said key engaging protrusion having a first radial edge to abut against said actuating surface of a corresponding one of said key bit projections and said key bit grooves on said key when said key is received in said key hole and is rotated to unlock said lock core unit, thereby permitting rotation of said lock plates by different angles corresponding to the angles of said actuating surfaces of said key bit projections and said key bit grooves on said key in order to align said engaging notches on said locking plates, said key engaging protrusion further having a second radial edge opposite to said first radial edge to abut against the other one of said first and second planar surfaces of said shank portion of said key when said key is received in said key hole and is rotated to lock said lock core unit, thereby permitting rotation of said locking plates in order to misalign said engaging notches on said locking plates according to the code of said key, and a locking rod received in said locking slot, misalignment of said engaging notches on said locking plates enabling said outer peripheries of said locking plates to force said locking rod to extend into said locking groove in order to prevent rotation of said inner shell relative to said lock shell when said lock core unit is in the locking position, alignment of said engaging notches on said locking plates enabling said locking rod to disengage said locking groove and to engage said engaging notches in order to permit rotation of said inner shell relative to said lock shell when said lock core unit is in the unlocking position.

3. The lock apparatus as claimed in claim 2, wherein said inner shell has a front chamber and a rear chamber, said locking plates being disposed in said front chamber, said latch actuator being coupled to said inner shell at said rear chamber.

4. The lock apparatus as claimed in claim 3, wherein said lock core unit further includes an annular drive plate disposed in said front chamber adjacent to said rear chamber of said inner shell and disposed between said latch actuator and said locking plates, said drive plate having a key engaging inner periphery and an outer periphery formed with a radial cam projection, said inner periphery of said drive plate engaging said shank portion of said key when said key is received in said key hole for co-rotation therewith, said latch actuator having a cam actuatable section which is driven by said cam projection such that rotation of said drive plate can result in corresponding rotation of said latch actuator between the locking and unlocking positions.

5. The lock apparatus as claimed in claim 4, wherein said latch actuator has a front end portion that extends into said rear chamber of said inner shell and that is formed with said cam actuatable section, an actuating rear end portion that extends out of said rear chamber of said inner shell, and a non-circular restricted neck portion between said front and rear end portions, said lock shell having a rear end provided with a retaining ring that is disposed around said neck portion of said latch actuator and that is formed with a radial inward limiting projection to limit rotation of said neck portion of said latch actuator relative to said lock shell between the locking and unlocking positions.

6. The lock apparatus as claimed in claim 2, wherein said lock core unit further includes a plurality of spacer plates, each of which is disposed between an adjacent pair of said locking plates and is formed with a central opening to permit extension of said shank portion of said key therethrough.

7. The lock apparatus as claimed in claim 6, wherein said inner shell is formed with an axially extending retaining slot, each of said spacer plates having a radial outward positioning projection that extends into said retaining slot to permit rotation of said spacer plates with said inner shell.

8. The lock apparatus as claimed in claim 2, wherein the arc length of said curved surface is about 270°.

9. The lock apparatus as claimed in claim 1, wherein the arc length of said curved surface is about 270°.

10. The lock apparatus as claimed in claim 2, wherein said lock shell has a front end portion provided with spring-loaded cover means for covering said key hole of said lock core unit when said key is removed from said lock core unit.

11. The lock apparatus as claimed in claim 1, wherein said lock shell has a front end portion provided with spring-loaded cover means for covering said key hole of said lock core unit when said key is removed from said lock core unit.

12. The lock apparatus as claimed in claim 11, wherein said spring-loaded cover means comprises:

a pair of cover plates mounted pivotally on opposite sides of said front end portion of said lock shell; and a pair of biasing springs mounted on said front end portion of said lock shell to bias said cover plates to a closed position relative to said lock shell, where said cover plates extend toward each other to close cooperatively said key hole of said lock core unit;

whereby, insertion of said key between said cover plates causing said cover plates to pivot and extend into said lock shell against biasing action of said biasing springs so as to uncover said key hole.

13. The lock apparatus as claimed in claim 11, wherein said spring-loaded cover means comprises:

a pair of cover plates mounted slidably on opposite sides of said front end portion of said lock shell; and a pair of biasing springs mounted on said front end portion of said lock shell to bias said cover plates to a closed position relative to said lock shell, where said cover plates extend toward each other to close cooperatively said key hole of said lock core unit;

whereby, insertion of said key between said cover plates causing said cover plates to move away from each other against biasing action of said biasing springs so as to uncover said key hole.

14. The lock apparatus as claimed in claim 13, wherein said cover plates have adjacent complementary indented edge portions to enable said key to force apart said cover plates when said key is inserted therebetween.

15. The lock apparatus as claimed in claim 11, wherein said spring-loaded cover means comprises:

a parallel pair of cylindrical rollers mounted rollingly on opposite sides of said front end portion of said lock shell; and a pair of biasing springs mounted on said front end portion of said lock shell to bias said rollers to a closed position relative to said lock shell, where said rollers extend toward each other to close cooperatively said key hole of said lock core unit;

whereby, insertion of said key between said rollers causing said rollers to move away from each other against biasing action of said biasing springs so as to uncover said key hole.

* * * * *